US011505392B2

(12) United States Patent
Jette et al.

(10) Patent No.: US 11,505,392 B2
(45) Date of Patent: Nov. 22, 2022

(54) EDGE PROTECTOR AND METHOD OF MANUFACTURING SAME

(71) Applicant: Signode Industrial Group LLC, Glenview, IL (US)

(72) Inventors: Martin F. Jette, Bradley, IL (US); Mathew S. Burton, Kankakee, IL (US); Rene Guerrero Camacho, Cleveland, NC (US); Randall John Rice, Cary, IL (US)

(73) Assignee: Signode Industrial Group LLC, Tampa, FL (US)

( * ) Notice: Subject to any disclaimer, the term of this patent is extended or adjusted under 35 U.S.C. 154(b) by 24 days.

(21) Appl. No.: 17/178,615

(22) Filed: Feb. 18, 2021

(65) Prior Publication Data

US 2021/0171264 A1 Jun. 10, 2021

Related U.S. Application Data

(63) Continuation of application No. 16/273,725, filed on Feb. 12, 2019, now Pat. No. 10,954,052.

(60) Provisional application No. 62/637,559, filed on Mar. 2, 2018.

(51) Int. Cl.
*B65D 81/05* (2006.01)
*B31D 5/00* (2017.01)

(52) U.S. Cl.
CPC ..... *B65D 81/054* (2013.01); *B31D 5/006* (2013.01); *B31D 2205/0005* (2013.01); *B65D 2581/053* (2013.01)

(58) Field of Classification Search
CPC ..... B65D 81/054; B65D 2581/053; B65D 81/053; B65D 81/05
USPC ..... 206/586, 453
See application file for complete search history.

(56) References Cited

U.S. PATENT DOCUMENTS

| | | | |
|---|---|---|---|
| 2,253,219 | A | 8/1941 | Alexander |
| 3,416,652 | A | 12/1968 | Almasy |
| 4,011,632 | A | 3/1977 | MacDonald |
| 4,771,893 | A | 9/1988 | Liebel |
| 4,865,201 | A | 9/1989 | Liebel |
| 4,938,357 | A | 7/1990 | Schmidt |
| 4,976,374 | A | 12/1990 | Macaluso |
| 5,040,684 | A | 8/1991 | Knowles |
| 5,131,541 | A | 7/1992 | Liebel |
| 5,181,611 | A | 1/1993 | Liebel |
| 5,232,762 | A | 8/1993 | Ruby |
| 5,772,037 | A | 6/1998 | Hurley |

(Continued)

FOREIGN PATENT DOCUMENTS

| | | |
|---|---|---|
| EP | 3119696 A2 | 1/2017 |
| EP | 3259205 B1 | 5/2020 |

(Continued)

OTHER PUBLICATIONS

"Canadian Office Action", from corresponding Canadian Patent Application No. 3,090,910, dated Mar. 11, 2022.

(Continued)

*Primary Examiner* — Steven A. Reynolds
(74) *Attorney, Agent, or Firm* — Neal, Gerber & Eisenberg LLP

(57) ABSTRACT

Various embodiments of the present disclosure provide an improved edge protector having two plies wrapped around a core and a method of manufacturing the improved edge protector.

5 Claims, 10 Drawing Sheets

(56) References Cited

U.S. PATENT DOCUMENTS

| | | | |
|---|---|---|---|
| 5,813,537 | A | 9/1998 | Dereu et al. |
| 5,918,800 | A | 7/1999 | Goshorn et al. |
| 5,947,290 | A | 9/1999 | Loeschen |
| 5,952,062 | A | 9/1999 | Clark et al. |
| 6,234,314 | B1 | 5/2001 | Qiu et al. |
| 6,527,119 | B1 | 3/2003 | Markert et al. |
| 6,540,080 | B2 | 4/2003 | Moreyra |
| 6,561,357 | B2 | 5/2003 | Renck |
| 6,611,995 | B2 | 9/2003 | Jackson et al. |
| 6,794,018 | B2 | 9/2004 | Clark |
| 7,111,734 | B2 | 9/2006 | Robinson |
| 7,213,381 | B2 | 5/2007 | Zitella et al. |
| 7,299,924 | B2 | 11/2007 | Robinson |
| 7,383,952 | B2 | 6/2008 | Kruelle et al. |
| 7,431,547 | B2 | 10/2008 | Geary et al. |
| 7,434,682 | B2 | 10/2008 | Valenzano et al. |
| 7,618,221 | B2 | 11/2009 | Thomson et al. |
| 7,661,579 | B2 | 2/2010 | Kruelle et al. |
| 7,838,095 | B2 | 11/2010 | Varma et al. |
| 8,443,975 | B2 | 5/2013 | Butch et al. |
| 8,753,731 | B2 | 6/2014 | Dunn |
| 9,764,527 | B2 | 9/2017 | D'anglade |
| 9,932,134 | B2 | 4/2018 | Suolahti et al. |
| 10,858,167 | B2 | 12/2020 | D'Anglade |
| 2005/0087663 | A1* | 4/2005 | Schroeder ..... B65D 81/054 206/586 |
| 2012/0000815 | A1 | 1/2012 | Butch et al. |

FOREIGN PATENT DOCUMENTS

| | | | |
|---|---|---|---|
| TW | M297354 | U | 9/2006 |
| WO | 2012162827 | A1 | 12/2012 |

OTHER PUBLICATIONS

"Office Action", from corresponding Canadian Patent Application No. 3,090,910, dated Sep. 23, 2021.

European Patent Office, "International Search Report and Written Opinion", from PCT/US2019/017773 (11 pages), dated Apr. 9, 2019.

* cited by examiner

EDGE PROTECTOR AND METHOD OF MANUFACTURING SAME

This patent application is a continuation of, claims priority to and the benefit of U.S. patent application Ser. No. 16/273,725, filed on Feb. 12, 2019, which claims priority to and the benefit of U.S. Provisional Patent Application No. 62/637,559, filed Mar. 2, 2018, the entire contents of which are incorporated herein by reference.

FIELD

The present disclosure generally relates to an improved edge protector and a method of manufacturing the improved edge protector. More particularly, the present disclosure relates to an improved edge protector having two plies wrapped around a core and a method of manufacturing the improved edge protector.

BACKGROUND

Edge protectors are rigid members used to protect the corners of loads during transit. Edge protectors are typically manufactured by laminating multiple plies of paperboard together using adhesive and then bending the laminated plies into an L-shaped member. In use, edge protectors are positioned on some or all of the exposed corners of a load and then held in place with straps that a strapping machine tensions around the load (and the edge protectors) or with film that a wrapping machine wraps around the load (and the edge protectors). FIG. 1 shows a prior art edge protector E positioned on a corner $L_C$ of a load L and held in place with tensioned straps S. Once positioned like this, the edge protectors act as barriers that protect the corners of the load from damage during transit.

SUMMARY

Various embodiments of the present disclosure provide an improved edge protector having two plies wrapped around a core and a method of manufacturing the improved edge protector.

In various embodiments, the edge protector comprises a first core having a first width; an inner wrap ply wrapped around and attached to the first core; a second core attached to the inner wrap ply and having a second width substantially the same as the first width; and an outer wrap ply wrapped around the second core, the first core, and the inner wrap ply and attached to the second core and the inner wrap ply. The first core, the inner wrap ply, the second core, and the outer wrap ply form a first leg and a second leg. The first leg is transverse to the second leg such that an outside corner and an inside corner are defined between the first and second legs.

In various embodiments, a method of manufacturing an edge protector comprises attaching a first core to a first portion of an inner wrap ply; attaching the first portion of the inner wrap ply to a second core; attaching a first portion of an outer wrap ply to the second core; wrapping second and third portions of the outer wrap ply and second and third portions of the inner wrap ply around the first and second cores such that the second and third portions of the inner wrap ply are attached to the first core and the second and third portions of the outer wrap ply are respectively attached to the second and third portions of the inner wrap ply; and bending the plies and the cores to form a first leg and a second leg transverse to the first leg.

Figure 1:
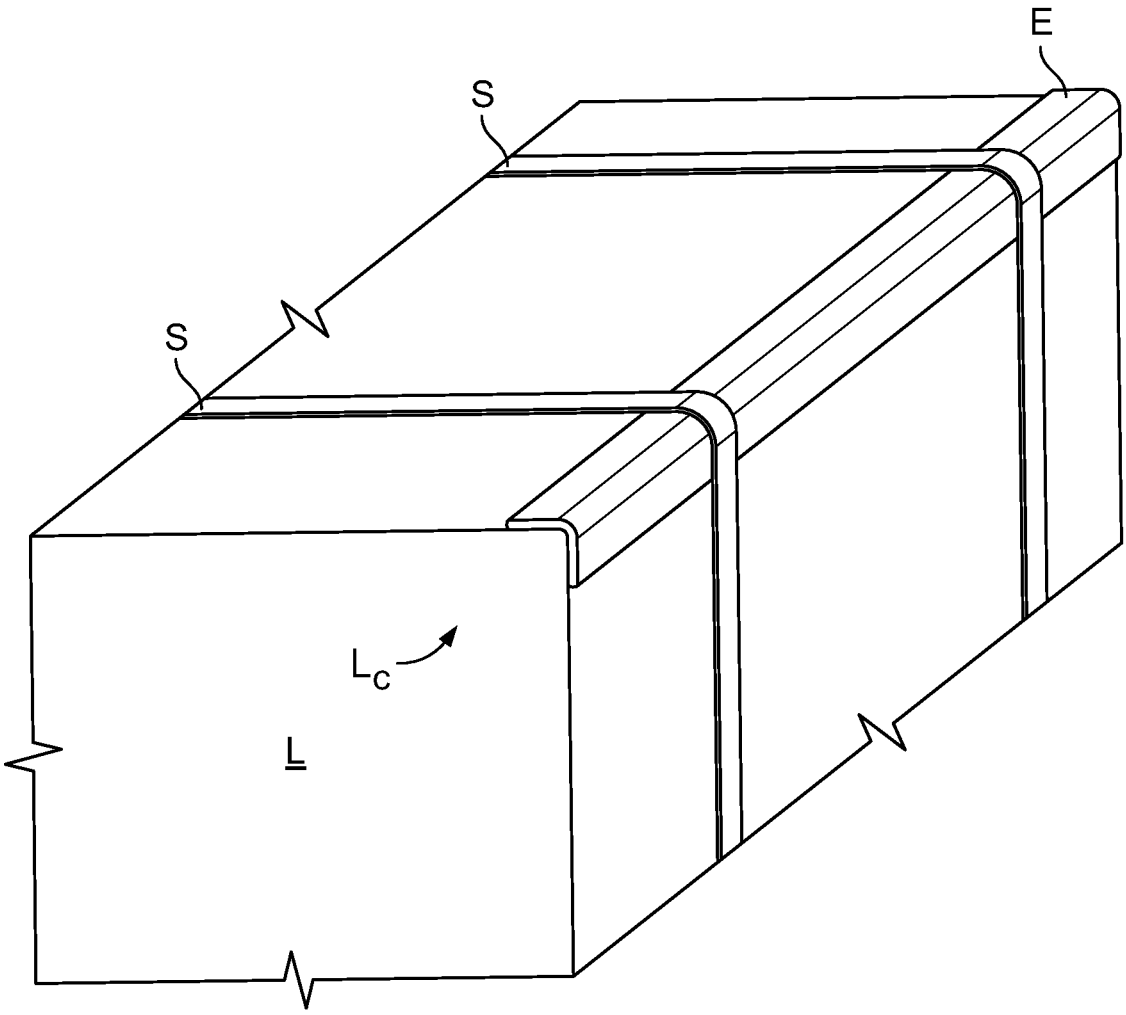
FIG. 1 (Prior Art)
FIG. 1 is a fragmentary perspective view of a prior art edge protector positioned on the corner of a load and held in place with tensioned straps.

The figures are not to scale and certain dimensions (such as the thicknesses of the plies) are exaggerated for clarity.

DETAILED DESCRIPTION

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. This specification is intended to be taken as a whole and interpreted in accordance with the principles of the present disclosure and as understood by one of ordinary skill in the art.

Figure 2:
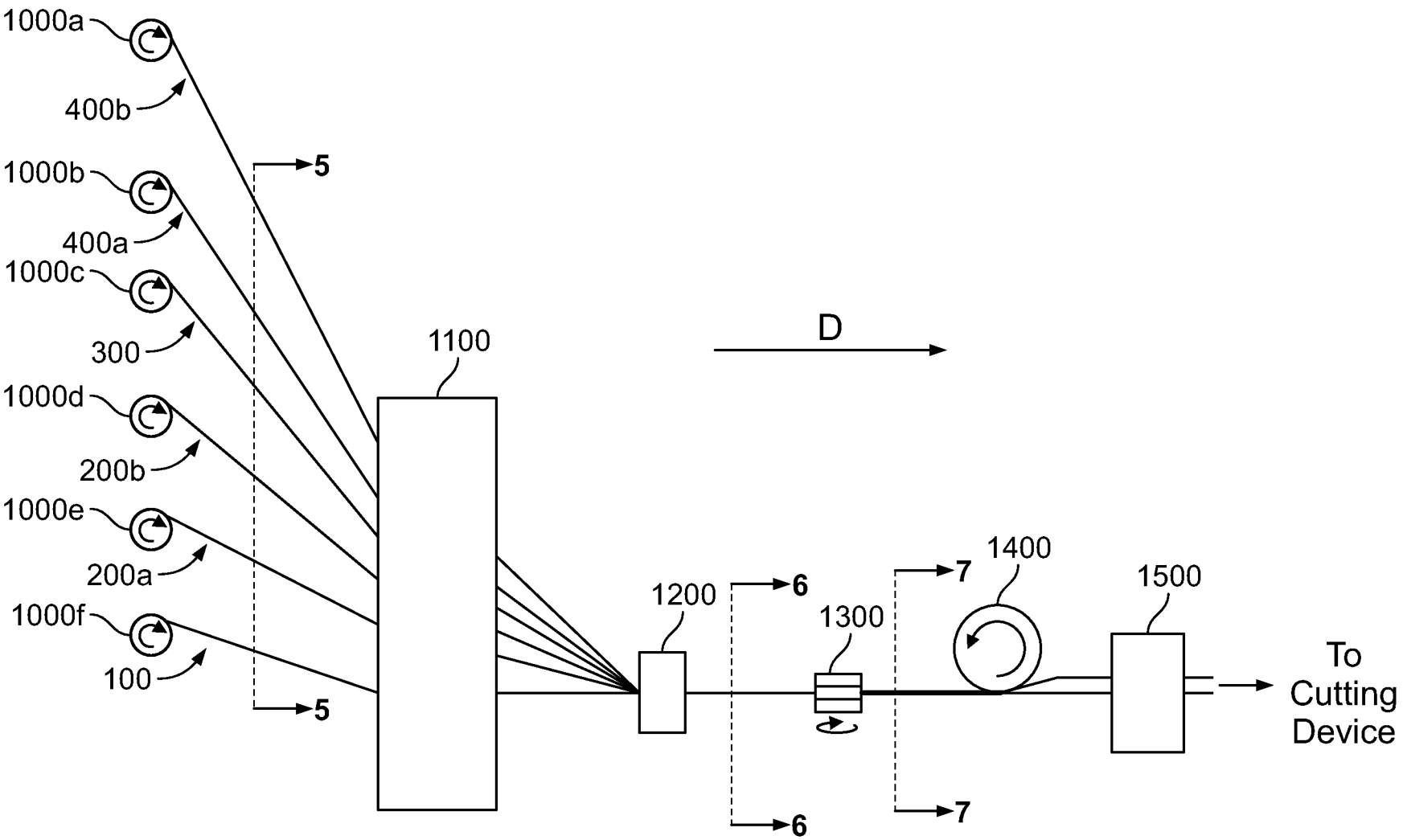
FIG. 2 is a diagrammatic side elevational view of part of one example edge protector manufacturing line of the present disclosure used to manufacture edge protectors of the present disclosure.
Figure 3:
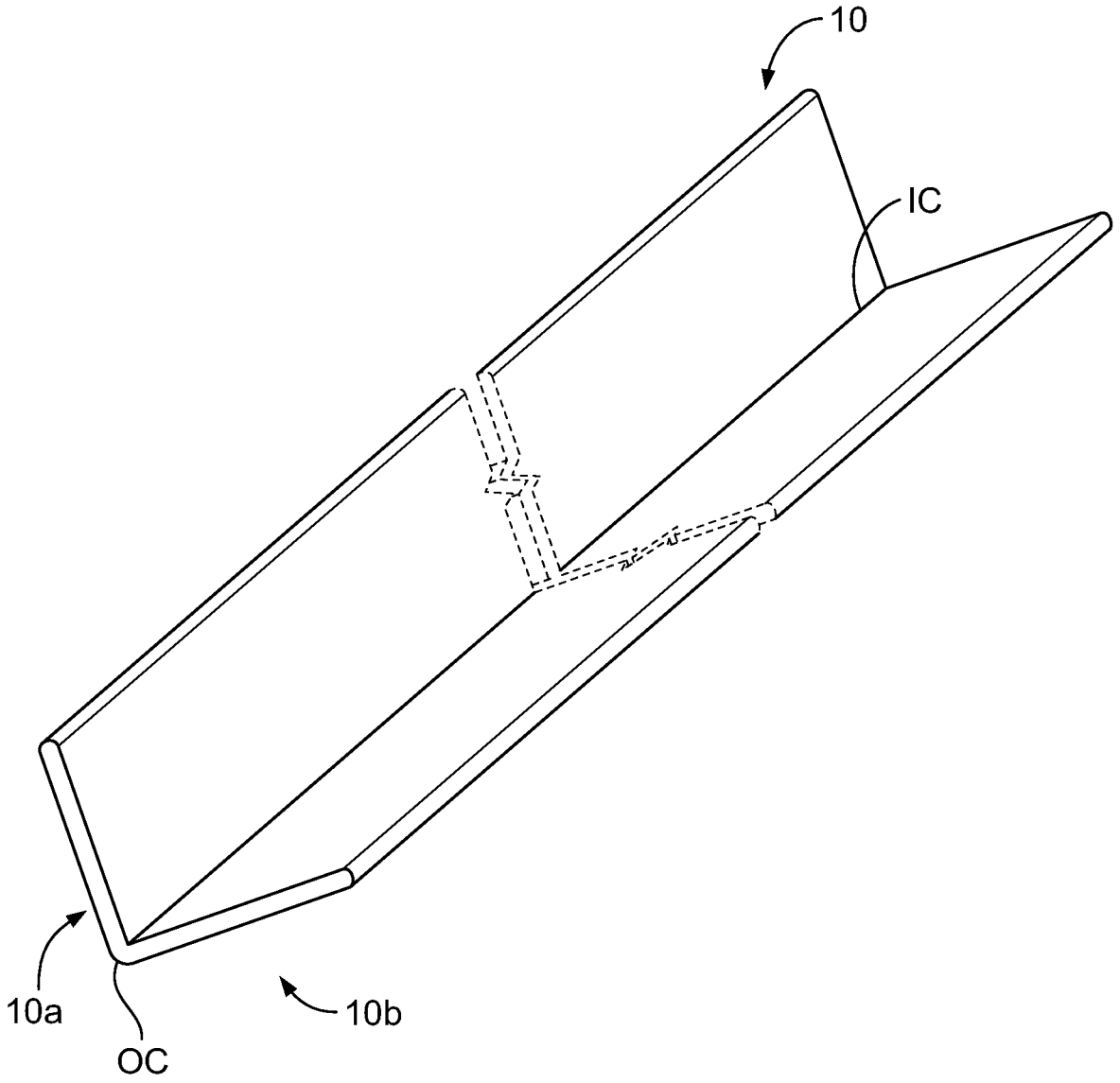
FIG. 3 is a perspective view of one example embodiment of the edge protector of the present disclosure manufactured by the edge protector manufacturing line of FIG. 2.
Figure 4:
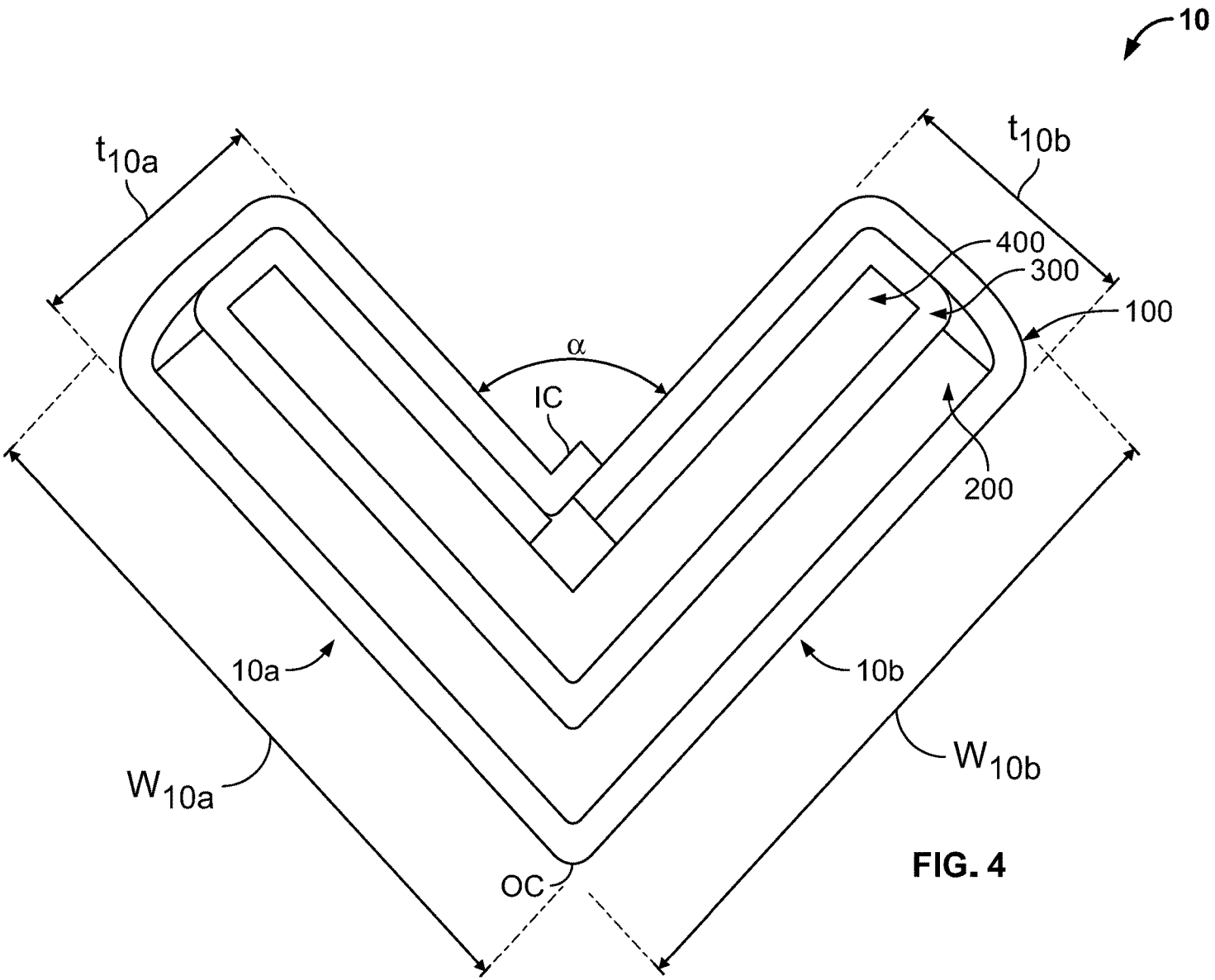
FIG. 4 is a side elevational view of the edge protector of FIG. 3.
Figure 5:
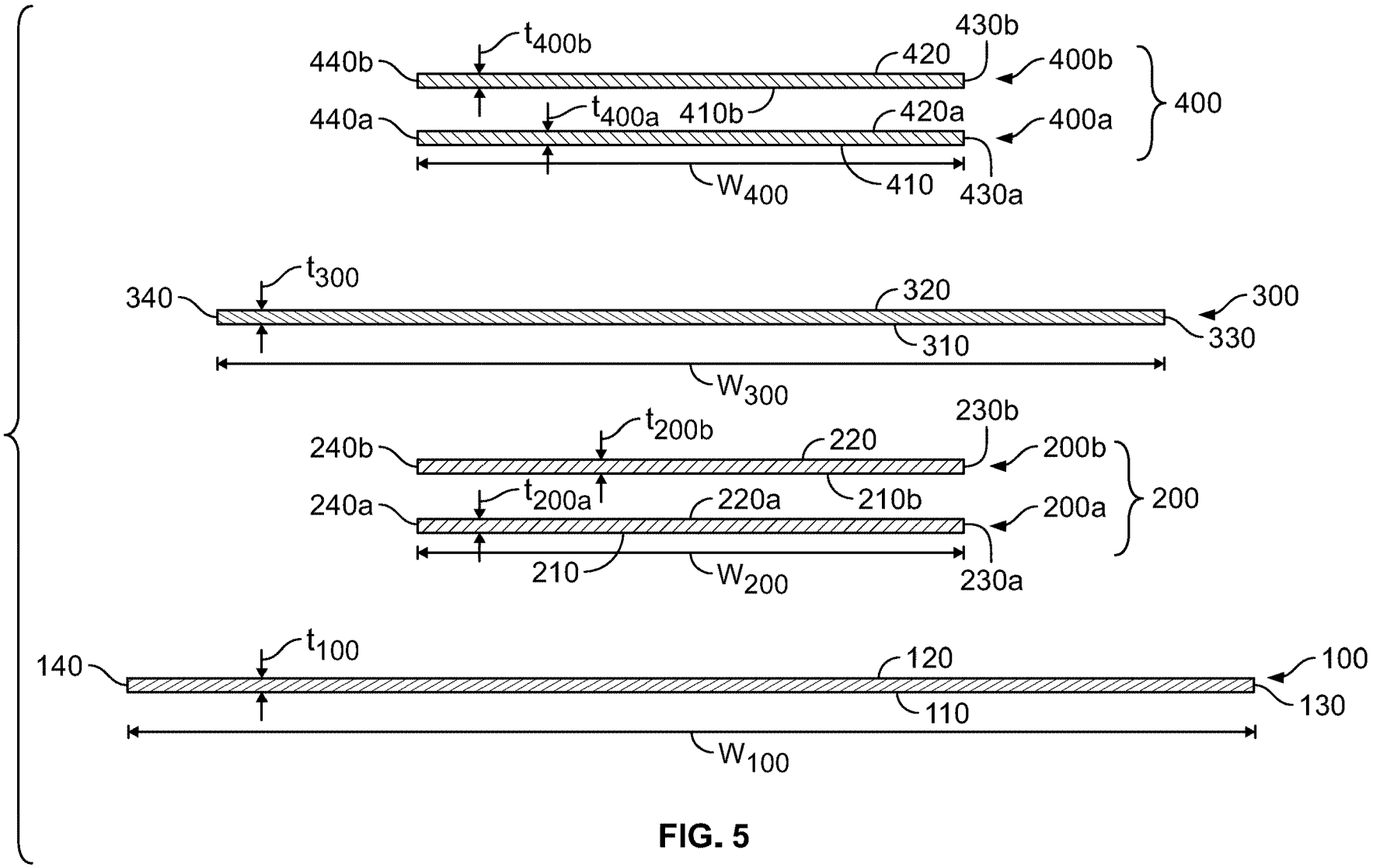
FIG. 5 is a cross-sectional view taken substantially along line 5-5 of FIG. 2 that shows the core and wrap plies that form the edge protector of FIG. 3 before adhesive has been applied to the plies.
Figure 6:
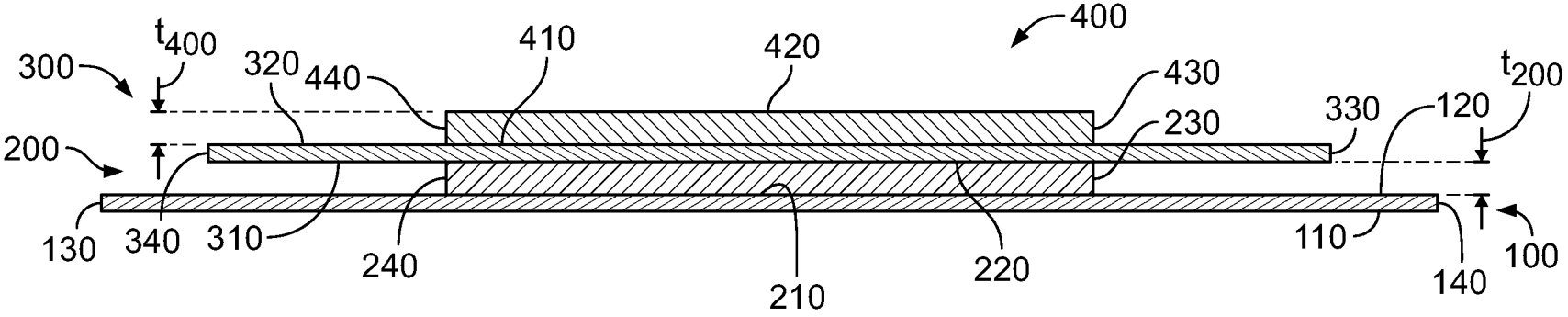
FIG. 6 is a cross-sectional view taken substantially along line 6-6 of FIG. 2 that shows the core and wrap plies that form the edge protector of FIG. 3 after the plies have been pressed into contact with one another but before the wrap plies have been wrapped around the core plies.
Figure 7:
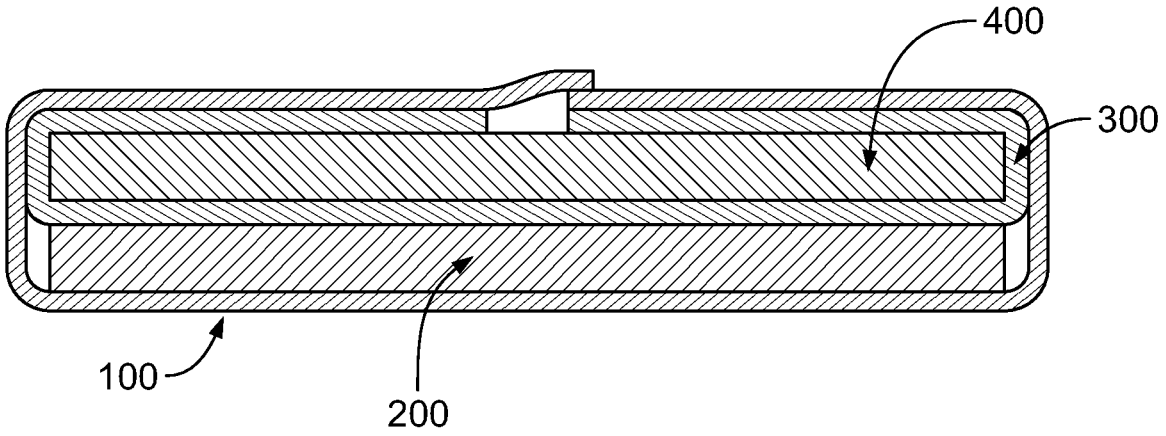
FIG. 7 is a cross-sectional view taken substantially along line 7-7 of FIG. 2 of the core and wrap plies that form the edge protector of FIG. 3 after the wrap plies have been wrapped around the core plies.

Turning now to the figures, FIG. 2 illustrates (in a simplified diagrammatic manner for clarity) several devices of one example embodiment of an edge protector manufacturing line used to manufacture one example embodiment of the edge protector 10 of the present disclosure, which is shown in FIGS. 3 and 4. FIGS. 5, 6, and 7 illustrate the components (namely, the plies) that make up the edge protector 10 at three different (and sequential) stages of the edge protector manufacturing process of one embodiment of the present disclosure, as described below.

As best shown in FIGS. 3 and 4, the edge protector 10 includes a first leg 10*a* and a second leg 10*b* that form inner and outer corners IC and OC and that are separated by an angle α (such as 90 degrees or any other suitable angle) such that the first and second legs 10*a* and 10*b* are transverse to one another. The first and second legs 10*a* and 10*b* are integrally formed, as described below. The first leg 10*a* has a width $W_{10a}$ and a thickness $t_{10a}$, and the second leg 10*b* has a width $W_{10b}$ and a thickness $t_{10b}$. The edge protector 10 may have any suitable length (not labeled). The edge protector 10 is formed from a first (such as an outer) wrap ply 100, a first core 200, a second (such as an inner) wrap ply 300, and a second core 400 that are attached to one another in a particular manner to impart strength to the edge protector 10.

As best shown in FIG. 5, the outer wrap ply 100 is a single paper or paperboard ply having a first (such as a bottom) surface 110, a second (such as a top) surface 120 opposite the bottom surface 110, a third (such as a right side) surface 130, and a fourth (such as a left side) surface 140 opposite the right side surface 130. The outer wrap ply 100 has a width $W_{100}$ and a thickness $t_{100}$. In other embodiments, the outer wrap ply may be formed from multiple plies.

As best shown in FIG. 5, the first core 200 is formed from two core plies of paper or paperboard 200*a* and 200*b* glued or otherwise attached together (as described below). The core ply 200*a* has a first (such as a bottom) surface 210, a second (such as a top) surface 220*a* opposite the bottom surface 210, a third (such as a right side) surface 230*a*, and a fourth (such as a left side) surface 240*a* opposite the right side surface 230*a*. The core ply 200*a* has a width $W_{200}$ and a thickness $t_{200a}$. The core ply 200*b* has a first (such as a bottom) surface 210*b*, a second (such as a top) surface 220 opposite the bottom surface 210*b*, a third (such as a right side) surface 230*b*, and a fourth (such as a left side) surface 240*b* opposite the right side surface 230*b*. The core ply 200*b* has a width $W_{200}$ and a thickness $t_{200b}$. As best shown in FIG. 6, once formed, the first core 200 has a first (such as a bottom) surface 210, a second (such as a top) surface 220 opposite the bottom surface 210, a third (such as a right side) surface 230 (formed from the right side surfaces 230*a* and 230*b*), and a fourth (such as a left side) surface 240 (formed from the left side surfaces 240*a* and 240*b*) opposite the right side surface 230. The first core 200 has a width $W_{200}$ and a thickness tax) (equal to the sum of $t_{200a}$ and $t_{200b}$). In other embodiments, the first core may be formed from more than two plies or from only one ply.

As best shown in FIG. 5, the inner wrap ply 300 is a single paper or paperboard ply having a first (such as a bottom) surface 310, a second (such as a top) surface 320 opposite the bottom surface 310, a third (such as a right side) surface 330, and a fourth (such as a left side) surface 340 opposite the right side surface 330. The inner wrap ply 300 has a width $W_{300}$ and a thickness $t_{300}$. In other embodiments, the inner wrap ply may be formed from multiple plies.

As best shown in FIG. 5, the second core 400 is formed from two core plies of paper or paperboard 400*a* and 400*b* glued or otherwise attached together (as described below). The core ply 400*a* has a first (such as a bottom) surface 410, a second (such as a top) surface 420*a* opposite the bottom surface 410, a third (such as a right side) surface 430*a*, and a fourth (such as a left side) surface 440*a* opposite the right side surface 430*a*. The core ply 400*a* has a width $W_{400}$ and a thickness $t_{400a}$. The core ply 400*b* has a first (such as a bottom) surface 410*b*, a second (such as a top) surface 420 opposite the bottom surface 410*b*, a third (such as a right side) surface 430*b*, and a fourth (such as a left side) surface 440*b* opposite the right side surface 430*b*. The core ply 400*b* has a width $W_{400}$ and a thickness $t_{400b}$. As best shown in FIG. 6, once formed, the second core 400 has a first (such as a bottom) surface 410, a second (such as a top) surface 420 opposite the bottom surface 410, a third (such as a right side) surface 430 (formed from the right side surfaces 430*a* and 430*b*), and a fourth (such as a left side) surface 440 (formed from the left side surfaces 440*a* and 440*b*) opposite the right side surface 430. The second core 400 has a width $W_{400}$ and a thickness $t_{400}$ (equal to the sum of $t_{400a}$ and $t_{400b}$). In other embodiments, the second core may be formed from more than two plies or from only one ply.

Regarding the widths of the wrap plies and the core plies (and thus the cores), in this example embodiment, the outer wrap ply 100 is wider than the inner wrap ply 300, which is wider than the first and second cores 200 and 400, which are the same width. More specifically: $W_{100}>W_{200}$, $W_{300}$, and $W_{400}$; $W_{300}>W_{200}$ and $W_{400}$; and $W_{200}=W_{400}$. In other embodiments, $W_{200}$ and $W_{400}$ are substantially the same, which for the purposes of the present disclosure means that they are no more than 10% different from one another. In certain embodiments, $W_{100}=W_{300}$ or $W_{100}$ and $W_{300}$ are substantially the same. In various embodiments, $W_{300}>W_{100}$.

$W_{100}$, $W_{200}$, $W_{300}$, and $W_{400}$ may be any suitable values that satisfy the above-described relationships. For instance, in various embodiments, $W_{100}$=4 to 28 inches; $W_{200}$=2.5 to 16 inches; $W_{300}$=4 to 28 inches; and $W_{400}$=2.5 to 16 inches. These ranges of values are exemplary and not intended to limit the present disclosure.

In this example embodiment, $W_{10a}$ and $W_{10b}$ are the same or substantially the same, and are generally equal to $((W_{200}/2)+t_{100})$. $W_{10a}$ and $W_{10b}$ may vary in accordance with $W_{100}$, $W_{200}$, $W_{300}$, and $W_{400}$.

Regarding the thicknesses of the wrap plies and the core plies (and thus the cores), in this example embodiment, the outer and inner wrap plies 100 and 300 have the same thickness, the first and second cores 200 and 400 have the same thickness, and the first and second cores 200 and 400 are thicker than the outer and inner wrap plies 100 and 300. More specifically: $t_{100}=t_{300}$; $t_{200}=t_{400}$; and $t_{100}$ and $t_{300}<t_{200}$ and $t_{400}$. In other embodiments, $t_{200}$ and $t_{400}$ are substantially the same and $t_{100}$ and $t_{300}$ are substantially the same, which for the purposes of the present disclosure means that they are no more than 10% different from one another. In certain embodiments, $t_{100}>t_{300}$ or $t_{300}>t_{100}$. In various embodiments, $t_{200}>t_{400}$ or $t_{400}>t_{200}$.

In various embodiments, $t_{100}$, $t_{200}$, $t_{300}$, and $t_{400}$ may be any suitable values that satisfy the above-described relationships. For instance, in various embodiments, $t_{100}$=0.005 to 0.030 inches; $t_{200}$=0.005 to 0.060 inches; $t_{300}$=0.005 to 0.050 inches; and $t_{400}$=0.005 to 0.060 inches. These ranges of values are exemplary and not intended to limit the present disclosure.

In this example embodiment, $t_{10a}$ and $t_{10b}$ are the same or substantially the same, and are generally equal to $(t_{100}+t_{100}+t_{200}+t_{300}+t_{300}+t_{400})$. $t_{10a}$ and $t_{10b}$ may vary in accordance with $t_{100}$, $t_{200}$, $t_{300}$, and $t_{400}$.

In certain embodiments, the wrap plies and the core plies all have the same thickness. In other embodiments, at least one of the plies is thicker or thinner than at least one other one of the plies.

The edge protector 10 is manufactured via the edge protector manufacturing line shown in FIG. 2. Generally, the devices in the edge protector manufacturing line are configured to laminate the wrap and core plies together via adhesive to form the first and second cores; wrap the inner wrap ply around the second core and wrap the outer wrap ply around the first core, the outer wrap ply, and the second core; bend the laminated and wrapped plies to form the two legs; and cut the laminated, wrapped, and bent plies into edge protectors of a desired length.

The edge protector manufacturing line includes: (1) a first roller 1000*a* on which a roll of the core ply 400*b* is rotatably mounted; (2) a second roller 1000*b* on which a roll of the core ply 400*a* is rotatably mounted; (3) a third roller 1000*c* on which a roll of the inner wrap ply 300 is rotatably mounted; (4) a fourth roller 1000*d* on which a roll of the core ply 200*b* is rotatably mounted; (5) a fifth roller 1000*e* on which a roll of the core ply 200*a* is rotatably mounted; (6) a sixth roller 1000*f* on which a roll of the outer wrap ply 100 is rotatably mounted; (7) an adhesive applicator 1100 downstream of the rollers 1000; (8) a laminating device 1200 downstream of the adhesive applicator 1100; (9) a wrapping device 1300 downstream of the laminating device 1200; (10) a bending device 1400 downstream of the wrapping device 1300; (11) a drive device 1500 downstream of the bending device 1400; (12) a cutting device (not shown) downstream of the drive device 1500; and (13) a controller (not shown).

Generally, and as described in detail below, the drive device 1500 pulls the plies off of their respective rolls and moves the plies in a direction D through the devices of the edge protector manufacturing line. As used herein, "downstream" means in the direction D and "upstream" means in a direction opposite the direction D.

In operation, the plies are pulled off of their respective rollers and generally move in a direction D into the adhesive applicator 1100. As best shown in FIG. 5, as the plies enter the adhesive applicator 1100, they are oriented such that the core ply 400*b* is above the core ply 400*a*, the core ply 400*a* is above the inner wrap ply 300, the inner wrap ply 300 is above the core ply 200*b*, the core ply 200*b* is above the core ply 200*a*, and the core ply 200*a* is above the outer wrap ply 100. The adhesive applicator 1100 is configured to apply adhesive to the top surfaces of each of the plies (i.e., the top surface 420 of the core ply 400*b*, the top surface 420*a* of the core ply 400*a*, the top surface 320 of the inner wrap ply 300, the top surface 220 of the core ply 200*b*, the top surface 220*a* of the core ply 200*a*, and the top surface 120 of the outer wrap ply 100). In other embodiments, the adhesive applicator 1100 can apply adhesive in various different manners and patterns. In certain embodiments, the adhesive applicator 1100 does not apply adhesive to certain of the plies.

The adhesive applicator 1100 includes any suitable component or components configured to apply the adhesive to the plies. In certain embodiments, the adhesive applicator 1100 includes multiple dispensers (such as tubes) fluidically connected to an adhesive supply and configured to direct the adhesive onto the top (and/or bottom) surfaces of the respective plies. In other embodiments, the adhesive applicator 1100 includes multiple rollers that take up adhesive from an adhesive supply and engage the top (and/or bottom) surfaces of the respective plies to apply adhesive to those surfaces. In further embodiments, the adhesive applicator 1100 includes one or more spray nozzles configured to spray adhesive onto the top (and/or bottom) surfaces of the respective plies. In certain embodiments, the adhesive applicator 1100 also includes multiple metering devices (such as squeegees, idle rollers, or stationary members) configured to spread the adhesive across the entire upper surfaces of the respective plies and to remove excess adhesive from the top surfaces of the respective plies. The excess adhesive is directed back into the adhesive supply to minimize waste.

The adhesive may be any suitable adhesive, such as water or non-water-based polyvinyl acetate adhesive, sodium silicate adhesive, or potato starch adhesive.

The plies are pulled in the direction D out of the adhesive applicator 1100 and into the laminating device 1200. The laminating device 1200 is configured to apply pressure to the plies to press them together such that the plies adhere to one another via the adhesive. More particularly and as best shown in FIG. 6, the laminating device 1200 is configured to press the plies together such that: (1) the top surface 120 of a first portion of the outer wrap ply 100 directly contacts and adheres to the bottom surface 210 of the core ply 200*a*; (2) the top surface 220*a* of the core ply 200*a* directly contacts and adheres to the bottom surface 210*b* of the core ply 200*b*, thereby forming the first core 200; (3) the top surface 220 of the core ply 200*b* directly contacts and adheres to the bottom surface 310 of a first portion of the inner wrap ply 300; (4) the top surface 320 of the first portion of the inner wrap ply 300 directly contacts and adheres to the bottom surface 410 of the core ply 400*a*; and (5) the top surface 420*a* of the core ply 400*a* directly contacts and adheres to the bottom surface 410*b* of the core ply 400*b*, thereby forming the second core 400. At this point in this example embodiment, opposing second and third portions of the outer wrap ply 100 that respectively extend outward in opposite directions from the first and second cores are not directly connected to the inner wrap ply or the first or second core, and opposing second and third portions of the inner wrap ply 300 that respectively extend outward in opposite directions from the first and second cores are not directly connected to the inner wrap ply of the first or second core. In other embodiments, the laminating device 1200 is configured to press the plies together such that the bottom surface 310 of the second and third portions of the inner wrap ply 300 directly contact and adhere to the top surface 120 of the second and third portions of the outer wrap ply, respectively.

The laminating device 1200 includes any suitable component or components configured to press the plies together. In certain embodiments, the laminating device 1200 includes a pair of idle rollers vertically spaced apart a distance that is less than (or in some embodiments equal to) the sum of $t_{100}$, $t_{200}$, $t_{300}$, and $t_{400}$ such that the idle rollers cause the plies to contact one another (as described above) as the plies are pulled through the idle rollers. In other embodiments, the laminating device 1200 comprises two static surfaces that converge together such that the surfaces are vertically spaced apart a distance that is less than (or in some embodiments equal to) the sum of $t_{100}$, $t_{200}$, $t_{300}$, and $t_{400}$ such that the surfaces direct the plies toward one another and cause the plies to contact one another as the plies are pulled past the surfaces. In certain such embodiments, one or more of the surfaces may have a friction-reducing coating (such as wax).

The plies may be attached to one another in other manners. For instance, in certain embodiments, the plies include a heat-activated adhesive that is inert at room temperature and activated when heated. In these embodiments, the adhesive applicator includes a heater configured to heat the plies as they move through the adhesive applicator. As the plies are heated, the adhesive activates such that the plies laminate together when passing through the laminating device.

The laminated plies are pulled in the direction D out of the laminating device 1200 and into the wrapping device 1300. The wrapping device 1300 is configured to (substantially simultaneously) wrap: (1) the second and third portions of the inner wrap ply 300 that extend outward beyond the widths of the first and second cores 200 and 400 around the second core 400; and (2) the second and third portions of the outer wrap ply 100 that extend outward beyond the widths of the first and second cores 200 and 400 around the first and second cores 200 and 400 and the inner wrap ply 300.

More particularly and as best shown in FIG. 7, the second and third portions of the inner wrap ply 300 are wrapped around the right and left side surfaces 430 and 440 of the second core 400 and onto the top surface 420 of the second core 400 such that the right and left side surfaces 330 and 340 of the inner wrap ply 300 generally face one another and are positioned at or near the center of the width of the second core 400. This causes the top surface 320 of the inner wrap ply 300 to directly contact and adhere to the right and left side surfaces 430 and 440 of the second core 400 and to directly contact and adhere to part of the top surface 420 of the second core 400. Once wrapped, the inner wrap ply 300 almost entirely surrounds the second core 400 in the width direction. In other embodiments, the inner wrap ply is wide enough such that its second and third portions overlap after wrapping such that the inner wrap ply completely surrounds the second core in the width direction.

Figure 9:
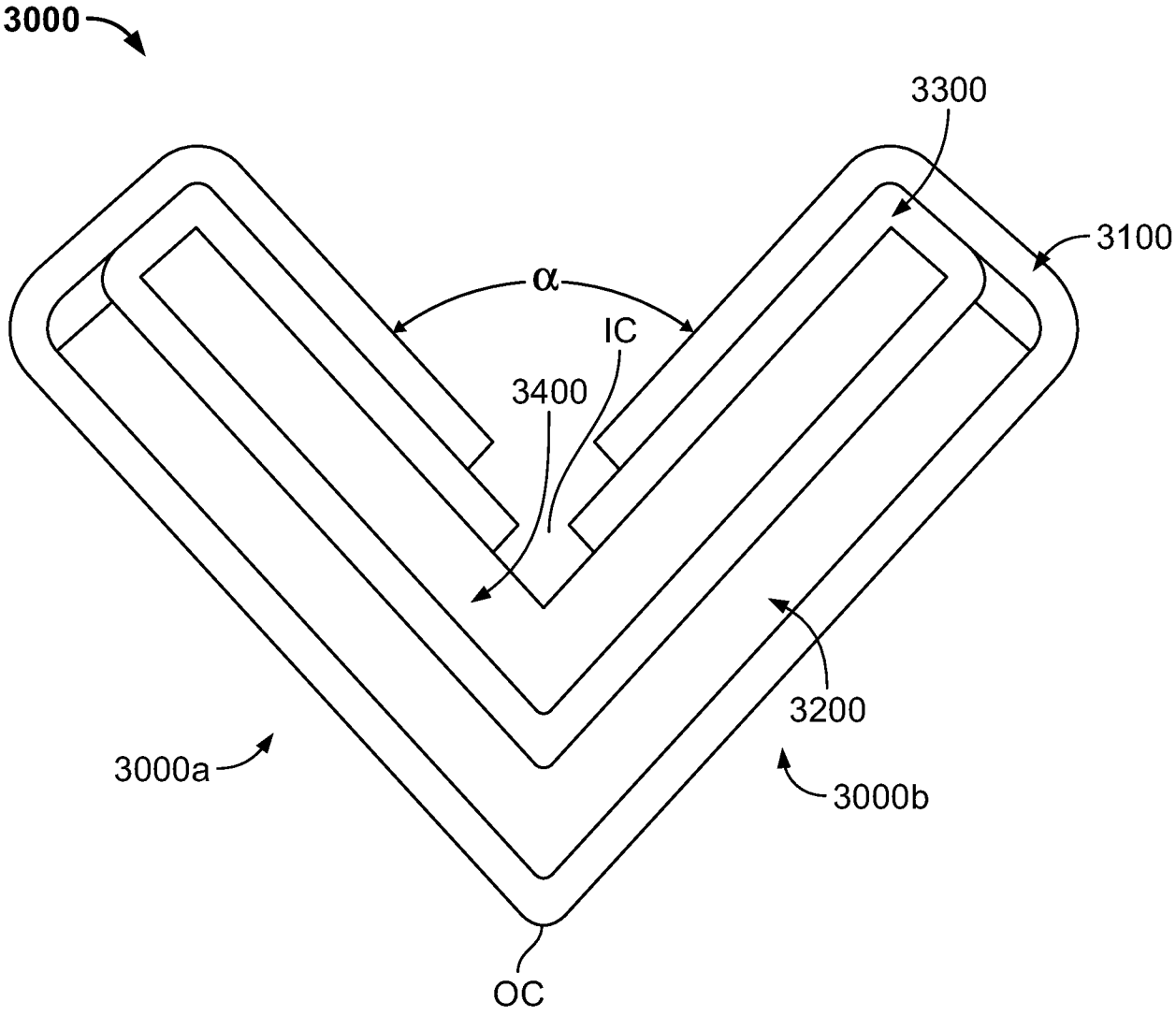
FIG. 9 is a side elevational view of another example embodiment of the edge protector of the present disclosure.

As also best shown in FIG. 7, the second and third portions of the outer wrap ply 100 are wrapped around the right and left side surfaces 230 and 240 of the first core 100 and around the inner wrap ply 300 and the second core 400. The outer wrap ply 100 is wide enough such that its second and third portions overlap at or near the center of the width of the second core 400. This causes part of the top surface 120 of the outer wrap ply 100 to directly contact and adhere to part of the bottom surface 110 of the outer wrap ply 100 where these portions overlap such that the outer wrap ply completely surrounds the first and second cores 200 and 400 and the inner wrap ply 300 in the width direction. Although not shown here for clarity, after wrapping part of the top surface 120 of the outer wrap ply 100 directly contacts and adheres to the right and left side surfaces 230 and 240 of the first core 200 and part of the top surface 120 of the outer wrap ply directly contacts the top surface 420 of the second core 400. In other embodiments, such as the embodiment of the edge protector 3000 shown in FIG. 9, the outer wrap ply 3100 is sized such that its ends do not overlap after wrapping such that the outer wrap ply 3100 does not completely surround the first and second cores 3200 and 3400 and the inner wrap ply 3300 in the width direction.

The wrapping device 1300 includes any suitable component or components configured to cause the second and third portions of the wrap plies to wrap around the cores. In certain embodiments, the wrapping device 1300 includes one or more pairs of wrapping members such as rollers. Each pair includes one roller on one side of the laminated plies and another on the other side of the laminated plies in a direction perpendicular to the direction D (i.e., the direction into the page when viewing FIG. 2). The wrapping rollers include outer wrap ply contact portions sized and positioned to contact the bottom surface 110 of the second and third portions of the outer wrap ply 100 and cause those portions of the outer wrap ply 100 to pivot upward into contact with the second and third portions of the inner wrap ply 300. Continued movement of the laminated plies past the wrapping rollers forces the second and third portions of the outer wrap ply 100 and the second and third portions of the inner wrap ply 300 to wrap around the first and second cores 200 and 400. In other embodiments, the wrapping device 1300 includes multiple stationary wrapping forgers sized and positioned to contact the bottom surface 110 of the outer wrap ply 100 and cause the outer wrap ply 100 and the inner wrap ply 300 to wrap around the first and second cores 200 and 400 as described above. In other embodiments, the wrapping device 1300 includes a forming box shaped and positioned to cause the outer wrap ply 100 and the inner wrap ply 300 to wrap around the first and second cores 200 and 300 as described above.

Although not shown in FIG. 2, the edge protector manufacturing line may include another laminating device similar to the laminating device 1200 downstream of the wrapping device 1300 that ensures the wrap plies contact each other and the cores such that they properly adhere to one another as described above.

In certain embodiments, the edge protector manufacturing line includes a scoring device that includes one or more components (such as rollers) configured to score one or more of the wrap plies (such as the outer wrap ply) before the wrapping device wraps the wrap plies around the cores. Each score is located at an area at which the wrapping device will cause the wrap ply to bend during wrapping. Scoring a wrap ply at the location(s) of the bend(s) reduces the likelihood that the wrap ply will tear at that location during wrapping.

The laminated and wrapped plies are pulled in the direction D out of the wrapping device 1300 and into the bending device 1400. The bending device 1400 is configured to bend the laminated and wrapped plies generally at the center of the width of the laminated and wrapped plies to form two legs of generally the same length that are separated by an angle $\alpha$, which is 90 degrees in this example embodiment (but may be any suitable angle in other embodiments). The bending device 1400 includes any suitable component or components configured to cause the laminated and wrapped plies to bend in this manner. In certain embodiments, the bending device 1400 includes a pair of male and female bending members such as rollers, one positioned above the laminated and wrapped plies and the other positioned below the laminated and wrapped plies. The male bending roller defines a V-shaped projection about its circumference, and the female roller defines a V-shaped recess about its circumference that is sized to receive the V-shaped projection of the male bending roller. The bending rollers are positioned relative to one another such that, as the laminated and wrapped plies are pulled through these rollers, the V-shaped projection of the male bending roller contacts and pushes the laminated and wrapped plies into the corresponding V-shaped recess of the female bending roller, which causes the laminated and wrapped plies to bend to conform to the shape of the recess. The bending device may include any suitable quantity of bending roller pairs. The bending roller pairs may be differently shaped such that the roller pairs gradually form the desired bend.

The laminated, wrapped, and bent plies are pulled in the direction D out of the bending device 1400 and into the drive device 1500. The drive device 1500 is configured to move the laminated, wrapped, and bent plies through the edge protector manufacturing line, and includes any suitable component or components to do so. In this example embodiment (although not shown), the drive device 1500 includes one or more actuators (such as motors) operably connected to one or more drive rollers. The drive rollers (which may be shaped and positioned similarly to the male and/or female rollers of the bending device described above) contact the laminated, wrapped, and bent plies and, when driven by the actuators, cause the laminated, wrapped, and bent plies to move through the edge protector manufacturing line. The drive device 1500 operates continuously during the edge protector manufacturing process to continuously move the plies through the edge protector manufacturing line, which rends this process a continuous manufacturing process. In certain embodiments, the drive device includes a first drive chain including first forming elements (such as teeth) and a second drive chain including second forming elements (such as teeth). The first forming elements may be receivable in recesses of the second forming elements (such as V-shaped recesses). The first drive chain is positioned above the laminated, wrapped, and bent plies and the second drive chain is positioned below the laminated, wrapped, and bent plies. An actuator (or actuators) is operatively connected to the first and second drive chains to drive the first and second drive chains. The drive chains are positioned such that the first and second drive teeth engage and compress the laminated, wrapped, and bent plies and pull the laminated, wrapped, and bent plies through the edge protector manufacturing line.

Although not shown here, the edge protector manufacturing line includes a cutting device downstream of the drive device 1500 and configured to cut the laminated, wrapped, and bent plies into individual edge protectors (such as the edge protector 10) of a desired length. The cutting device may include a reciprocatable blade and an actuator (such as a motor) operably connected to the blade to move the blade from a rest position to a cutting position to cut the individual edge protectors. The cutting device may include another actuator configured to move the cutting device in the direction D. This actuator enables the cutting device to match the speed of the laminated, wrapped, and bent plies just before cutting to prevent or minimize slowdown of the plies through the edge protector manufacturing line during cutting.

The controller is configured to control the drive device 1500 to move the plies through the edge protector manufacturing line and to control the cutting device as described above.

Figure 8:
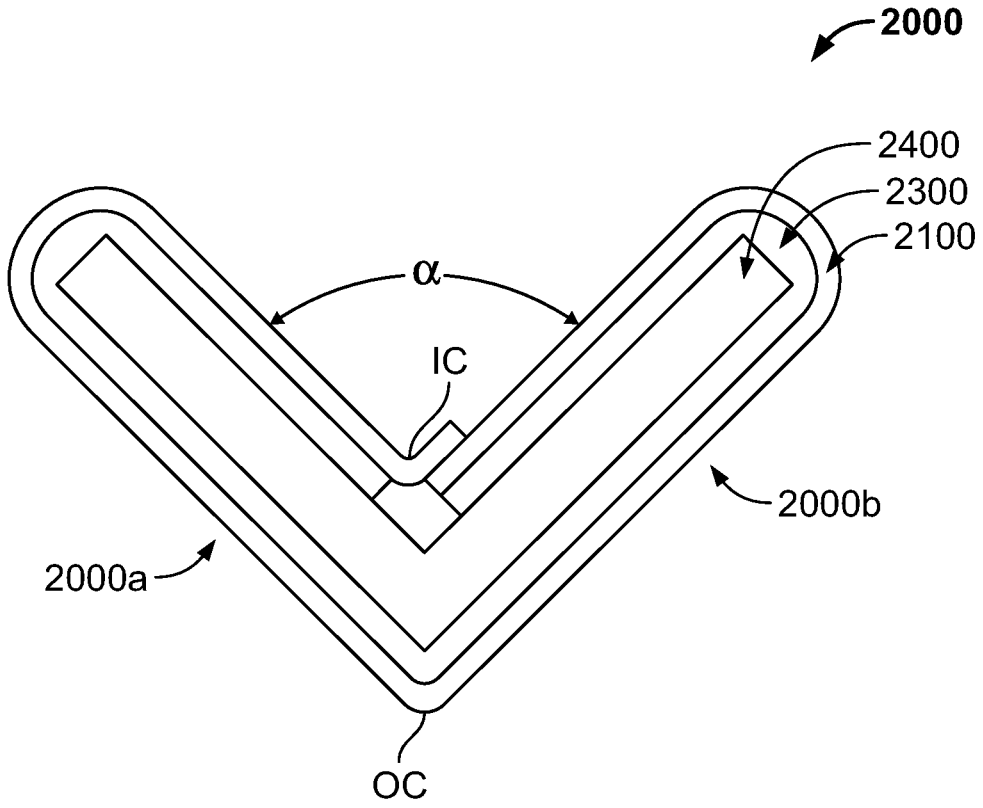
FIG. 8 is a side elevational view of another example embodiment of the edge protector of the present disclosure.

FIG. 8 shows another embodiment of the edge protector 2000 of the present disclosure that includes a first leg 2000*a* and a second leg 2000*b* that form inner and outer corners IC and OC and that are separated by an angle α (such as 90 degrees or any other suitable angle). The edge protector 2000 is formed from an outer wrap ply 2100, an inner wrap ply 2300, and a core 2400. That is, the edge protector 2000 differs from the edge protector 10 in that the edge protector 2000 has a single core rather than two cores. The edge protector 2000 may be manufactured in a manner similar to that described above.

Figure 10:
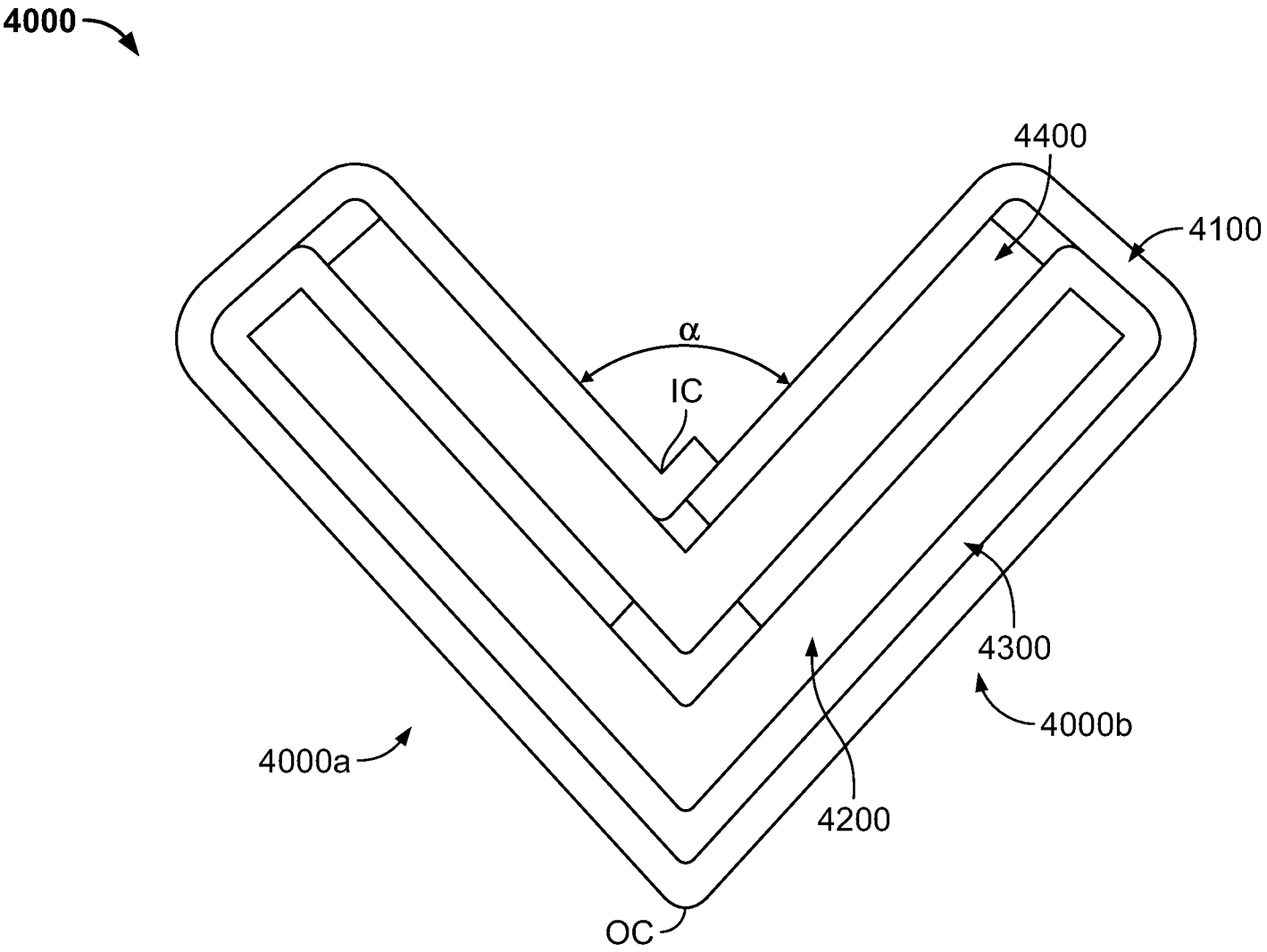
FIG. 10 is a side elevational view of another example embodiment of the edge protector of the present disclosure.

FIG. 10 shows another embodiment of the edge protector 4000 of the present disclosure that includes a first leg 4000*a* and a second leg 4000*b* that form inner and outer corners IC and OC and that are separated by an angle α (such as 90 degrees or any other suitable angle). The edge protector 4000 is formed from an outer wrap ply 4100, an inner wrap ply 4300, a first core 4200, and a second core 4400. The inner wrap ply 4300 is wrapped around the first core 4200 such that a portion of the inner wrap ply 4300 directly contacts and is sandwiched between the first and second cores 4200 and 4400. The outer wrap ply 4100 is wrapped around the first core 4200, the inner wrap ply 4300, and the second core 4400 such that the outer wrap ply 4100 directly contacts the inner wrap ply 4300 and the second core 4400 and such that a portion of the inner wrap ply 4300 directly contacts and is sandwiched between the outer wrap ply 4100 and the first core 4200.

Figure 11:
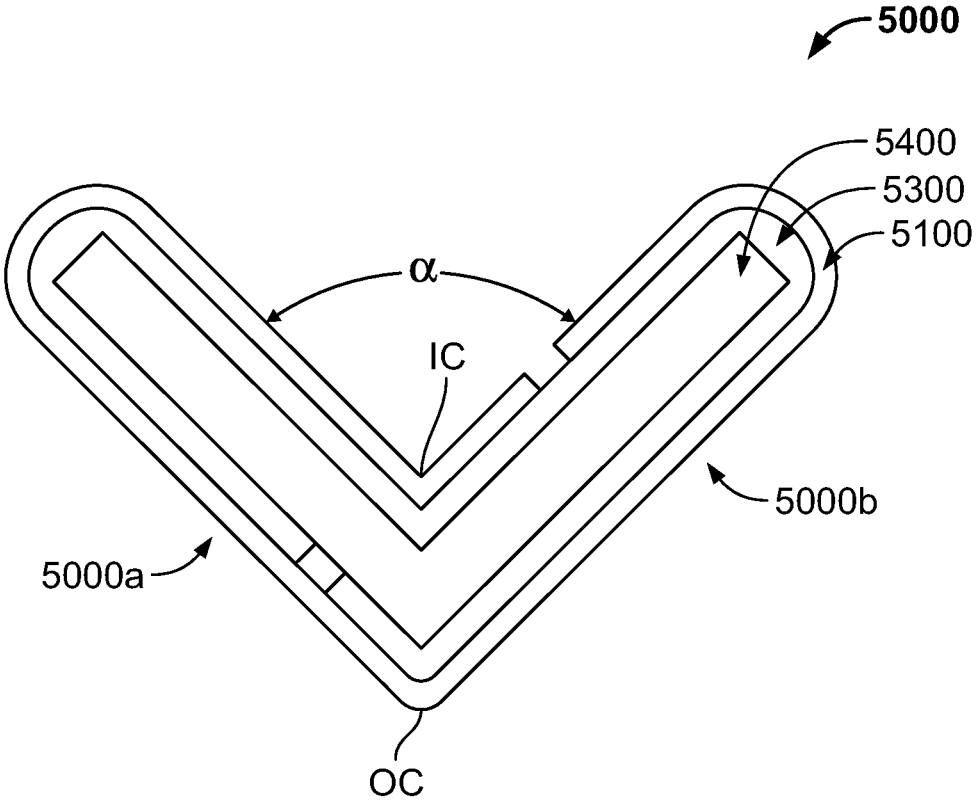
FIG. 11 is a side elevational view of another example embodiment of the edge protector of the present disclosure.

FIG. 11 shows another embodiment of the edge protector 5000 of the present disclosure that includes a first leg 5000*a* and a second leg 5000*b* that form inner and outer corners IC and OC and that are separated by an angle α (such as 90 degrees or any other suitable angle). The edge protector 5000 is formed from an outer wrap ply 5100, an inner wrap ply 5300, and a core 5400. That is, the edge protector 5000 differs from the edge protector 10 in that the edge protector 5000 has a single core rather than two cores. The inner wrap ply 5300 wraps around the core 5400 such that it partially surrounds the core 5400 and the ends of the inner wrap ply 5300 are spaced apart from and do not overlap one another (and are positioned on the first leg 5000*a*) Similarly, the outer wrap ply 5100 partially wraps around the inner wrap ply 5300 and the core 5400 such that it partially surrounds the core 5400 and the inner wrap ply 5300 and the ends of the outer wrap ply 5100 are spaced apart from and do not overlap one another (and are positioned on the second leg 5000*b*). In this example embodiment, the outer wrap ply is wider than the inner wrap ply, though they may have equal widths in other embodiment or the inner wrap ply may be wider than the outer wrap ply in other embodiments. In other embodiments, one or both of the inner wrap ply and the outer wrap ply completely surround the core. The edge protector 5000 may be manufactured in a manner similar to that described above.

Although the plies are described above as being made of paper or paperboard, in other embodiments the plies may be made of any suitable material, such as plastic, corrugated, or low-density polyethylene coated paper.

In various embodiments, the edge protector comprises a first core having a first width; an inner wrap ply wrapped around and attached to the first core; a second core attached to the inner wrap ply and having a second width substantially the same as the first width; and an outer wrap ply wrapped around the second core, the first core, and the inner wrap ply and attached to the second core and the inner wrap ply. The first core, the inner wrap ply, the second core, and the outer wrap ply form a first leg and a second leg. The first leg is transverse to the second leg such that an outside corner and an inside corner are defined between the first and second legs.

In one such embodiment, the first width and the second width are the same.

In another such embodiment, the first leg and the second leg are perpendicular.

In another such embodiment, the inner wrap ply is the only ply separating the first and second cores.

In another such embodiment, the first core is formed from multiple core plies attached to one another.

In another such embodiment, the second core is formed from multiple core plies attached to one another.

In another such embodiment, the first core has a first thickness, the second core has a second thickness, the inner wrap ply has a third thickness, and the outer wrap ply has a fourth thickness. The first thickness is greater than the third thickness and the fourth thickness. The second thickness is greater than the third thickness and the fourth thickness.

In another such embodiment, the first thickness is the same as the second thickness and the third thickness is the same as the fourth thickness.

In various embodiments, a method of manufacturing an edge protector comprises attaching a first core to a first portion of an inner wrap ply; attaching the first portion of the inner wrap ply to a second core; attaching a first portion of an outer wrap ply to the second core; wrapping second and third portions of the outer wrap ply and second and third portions of the inner wrap ply around the first and second cores such that the second and third portions of the inner wrap ply are attached to the first core and the second and third portions of the outer wrap ply are respectively attached to the second and third portions of the inner wrap ply; and bending the plies and the cores to form a first leg and a second leg transverse to the first leg.

In one such embodiment, the method further comprises applying adhesive to the first core, the inner wrap ply, the second core, and the outer wrap ply. Applying the adhesive comprises applying the adhesive to respective top surfaces of the first core, the inner wrap ply, the second core, and the outer wrap ply.

In another such embodiment, attaching the first core to the first portion of the inner wrap ply comprises attaching a bottom surface of the first core opposite the top surface of the first core to the top surface of the inner wrap ply.

In another such embodiment, attaching the first portion of the inner wrap ply to the second core comprises attaching a bottom surface of the inner wrap ply opposite the top surface of the inner wrap ply to a top surface of the second core.

In another such embodiment, attaching the first portion of the outer wrap ply to the second core and to the inner wrap ply comprises attaching the top surface of the outer wrap ply to a bottom surface of the second core opposite the top surface of the second core.

In another such embodiment, wrapping the second and third portions of the outer wrap ply and second and third portions of the inner wrap ply around the first and second cores comprises attaching the top surface of the inner wrap ply to the top surface of the first core.

In another such embodiment, the method further comprises scoring the outer wrap ply before wrapping the second and third portions of the outer wrap ply and second and third portions of the inner wrap ply. Wrapping the second and third portions of the outer wrap ply and second and third portions of the inner wrap ply around the first and second cores further comprises attaching part of the second portion of the outer wrap ply to part of the third portion of the outer wrap ply such that the outer wrap ply surrounds the first and second cores and the inner wrap ply.

The present disclosure contemplates that any features of the different example embodiments above may be combined together. Various changes and modifications to the presently preferred embodiments described herein will be apparent to those skilled in the art. These changes and modifications can be made without departing from the spirit and scope of the present subject matter and without diminishing its intended advantages. It is intended that such changes and modifications be covered by the appended claims.

The invention claimed is:

1. An edge protector comprising:

a core having a first width;

an inner wrap ply wrapped around and attached to the core such that at least a portion of the core is positioned between at least two portions of the inner wrap ply, wherein the inner wrap ply has a second width that is greater than the first width; and an outer wrap ply wrapped around the core and the inner wrap ply such that the outer wrap ply completely surrounds the core and the inner wrap ply in the width direction so two portions of the outer wrap ply overlap one another, wherein the outer wrap ply is attached to the inner wrap ply, wherein the outer wrap ply has a third width that is greater than the first width and is greater than the second width, wherein the core, the inner wrap ply, and the outer wrap ply form a first leg and a second leg, wherein the first leg is transverse to the second leg such that an outside corner and an inside corner are defined between the first and second legs, wherein the core, the inner wrap ply, and the outer wrap ply are each formed from paperboard.

2. The edge protector of claim 1, wherein the portions of the outer wrap ply that overlap one another are located near the inside corner.

3. The edge protector of claim 1, wherein the first leg and the second leg are perpendicular.

4. The edge protector of claim 1, wherein the inner wrap ply is the only ply separating the core and the outer wrap ply.

5. The edge protector of claim 1, wherein core is formed from multiple core plies attached to one another.

* * * * *